US011231194B2

(12) United States Patent
Fan et al.

(10) Patent No.: US 11,231,194 B2
(45) Date of Patent: Jan. 25, 2022

(54) METHOD FOR CONTROLLING AN AIR CONDITIONER, ELECTRONIC DEVICE, AND COMPUTER-READABLE STORAGE MEDIUM

(71) Applicants: GD Midea Air-Conditioning Equipment Co., Ltd., Guangdong (CN); MIDEA GROUP CO., LTD, Guangdong (CN)

(72) Inventors: Qifeng Fan, Guangdong (CN); Jiwei Hei, Guangdong (CN)

(73) Assignees: GD Midea Air-Conditioning Equipment Co., Ltd., Guangdong (CN); MIDEA GROUP CO., LTD, Guangdong (CN)

( * ) Notice: Subject to any disclaimer, the term of this patent is extended or adjusted under 35 U.S.C. 154(b) by 70 days.

(21) Appl. No.: 16/821,382

(22) Filed: Mar. 17, 2020

(65) Prior Publication Data

US 2020/0217540 A1 Jul. 9, 2020

Related U.S. Application Data

(63) Continuation of application No. PCT/CN2017/113364, filed on Nov. 28, 2017.

(30) Foreign Application Priority Data

Sep. 30, 2017 (CN) ..... 201710932543.0

(51) Int. Cl.
*F24F 11/30* (2018.01)
*F24F 11/64* (2018.01)
*F24F 11/58* (2018.01)

(52) U.S. Cl.
CPC ..... *F24F 11/30* (2018.01); *F24F 11/58* (2018.01); *F24F 11/64* (2018.01)

(58) Field of Classification Search
CPC .. F24F 11/30; F24F 11/64; F24F 11/58; F24F 11/62
See application file for complete search history.

(56) References Cited

U.S. PATENT DOCUMENTS

2005/0005619 A1* 1/2005 Kojima ..... F24F 11/30 62/132
2008/0186148 A1* 8/2008 Kwon ..... G05B 15/02 340/286.02

(Continued)

FOREIGN PATENT DOCUMENTS

CN 103759386 A 4/2014
CN 105910232 A 8/2016

(Continued)

OTHER PUBLICATIONS

International Search Report dated Jun. 8, 2018 issued in PCT International Application No. PCT/CN2017/113364.

(Continued)

*Primary Examiner* — Ramesh B Patel
(74) *Attorney, Agent, or Firm* — Scully Scott Murphy & Presser

(57) ABSTRACT

A method for controlling an air conditioner including: determining at least one first air conditioner within a first preset distance from the air conditioner; determining control information of the air conditioner based on current operating state of the at least one first air conditioner; and controlling operation of the air conditioner according to the control information of the air conditioner. An electronic device and a non-transitory computer-readable storage medium.

14 Claims, 4 Drawing Sheets

(56) References Cited

U.S. PATENT DOCUMENTS

2008/0195564 A1* 8/2008 Kojima ..... B60H 1/00971 706/12
2014/0005838 A1* 1/2014 Ogura ..... F24F 11/30 700/276
2015/0061841 A1* 3/2015 Lee ..... G08C 17/02 340/12.5
2015/0293540 A1* 10/2015 Izumihara ..... G05B 19/042 700/276
2015/0308704 A1* 10/2015 Jung ..... F24F 11/30 700/276
2016/0025369 A1* 1/2016 Lim ..... F24F 11/30 236/1 C
2017/0234562 A1* 8/2017 Ribbich ..... G05D 23/1923 700/277
2017/0315697 A1* 11/2017 Jacobson ..... H04L 12/2816
2017/0328595 A1* 11/2017 Iwasaki ..... F24F 11/46
2017/0363312 A1* 12/2017 Crimins ..... G05B 19/042
2019/0033807 A1* 1/2019 Inoue ..... F24F 11/89
2019/0041080 A1* 2/2019 Higuchi ..... F24F 11/56
2020/0025403 A1* 1/2020 Oumi ..... F24F 11/49
2020/0284460 A1* 9/2020 Hur ..... F24F 11/54
2021/0080141 A1* 3/2021 Tsuboi ..... F24F 11/63

FOREIGN PATENT DOCUMENTS

CN 106091270 A 11/2016
JP 2009-014281 A 1/2009
KR 20050074827 A 7/2005

OTHER PUBLICATIONS

Written Opinion of International Search Authority dated Jun. 8, 2018, issued in PCT International Application No. PCT/CN2017/113364.

* cited by examiner

METHOD FOR CONTROLLING AN AIR CONDITIONER, ELECTRONIC DEVICE, AND COMPUTER-READABLE STORAGE MEDIUM

CROSS-REFERENCE TO RELATED APPLICATIONS

The subject application is a continuation of PCT International Application No. PCT/CN2017/113364, filed on Nov. 28, 2017, which claims priority to Chinese Patent Application No. 201710932543.0, filed on Sep. 30, 2017. The entire disclosures of PCT International Application No. PCT/CN2017/113364 and Chinese Patent Application No. 201710932543.0 are incorporated by reference herein.

FIELD

The present disclosure relates to the field of household appliances, and more particularly relates to a method for controlling an air conditioner, an electronic device, and a non-transitory computer-readable storage medium.

BACKGROUND

Currently, air conditioner control involves controlling operating parameters of an air conditioner by using historical control records or instant control commands sent by users. However, the manner relying on the historical control records is only applicable to the air conditioner that has been controlled by users. In case of a newly purchased air conditioner, or an air conditioner that is put into use again after being on shelf for a long time, there may be an error in controlling the air conditioner due to changes in climate or weather, thereby adversely impacting comfort.

The above content is merely used to assist in understanding the technical solutions of the present disclosure and is not intended to represent that the above content is prior art.

SUMMARY

The present disclosure provides a method for controlling an air conditioner, an electronic device, and a computer-readable storage medium, aiming to solve the problem that the manner relying on the historical control records is only applicable to the air conditioner that has been controlled by users, however, in case of a newly purchased air conditioner, or an air conditioner that is put into use again after being on shelf for a long time, there may be an error in controlling the air conditioner due to changes in climate or weather, thereby adversely impacting comfort.

In one aspect, the present disclosure provides a method for controlling an air conditioner including:

determining at least one first air conditioner within a first preset distance from the air conditioner;

determining control information of the air conditioner based on current operating state of the at least one first air conditioner; and controlling operation of the air conditioner according to the control information of the air conditioner.

In some embodiments, the operation of determining control information of the air conditioner according to current operating state of the at least one first air conditioner includes:

determining a control parameter corresponding to the operating state of each of the at least one first air conditioner, after obtaining the current operating state of the at least one first air conditioner; and extracting one of all the determined control parameters with most occurrences as the control information of the air conditioner.

In some embodiments, in an area where there is a large change in climate, the first preset distance is configured with different values according to different directions.

In some embodiments, the operation of determining control information of the air conditioner based on current operating state of the at least one first air conditioner includes:

determining environmental information of the air conditioner based on the current operating state of the at least one first air conditioner; and determining the control information of the air conditioner based on the environmental information of the air conditioner.

In some embodiments, the operation of determining control information of the air conditioner based on current operating state of the at least one first air conditioner includes:

deleting operating state satisfying a preset condition from the obtained current operating state of the at least one first air conditioner, marking the operating state after the deletion as new operating state; and determining the control information of the air conditioner based on the new operating state.

In some embodiments, the method further includes:

in response to a determination that there is no first air conditioner within the first preset distance, determining a second air conditioner within a distance larger than a second preset distance; and obtaining current operating state of the second air conditioner, and determining the control information of the air conditioner, based on a difference between the first preset distance and the second preset distance, and the current operating state of the second air conditioner, where the second preset distance is larger than the first preset distance.

In some embodiments, the operation of determining the control information of the air conditioner, based on a difference between the first preset distance and the second preset distance, and the current operating state of the second air conditioner includes:

determining a compensation value for the control information based on the difference between the first preset distance and the second preset distance; and correcting the control information of the air conditioner with the compensation value, and taking the corrected control information as the control information of the air conditioner.

In some embodiments, after the operation of determining control information of the air conditioner based on current operating state of the at least one first air conditioner, the method further includes:

in response to a difference in the number of users between currently enjoying the air conditioner and currently enjoying the at least one first air conditioner, correcting the control information of the air conditioner based on the difference in the number of users, to obtain corrected control information; and controlling the operation of the air conditioner according to the corrected control information.

In some embodiments, after the operation of determining control information of the air conditioner based on current operating state of the at least one first air conditioner, the method further includes:

in response to a difference in the number of users between currently enjoying the air conditioner and currently enjoying the at least one first air conditioner, correcting the control information of the air conditioner based on a difference in state of the users, to obtain corrected control information; and controlling the operation of the air conditioner according to the corrected control information.

In some embodiments, after the operation of determining control information of the air conditioner based on current operating state of the at least one first air conditioner, the method further includes:

in response to a difference in the number of users between currently enjoying the air conditioner and currently enjoying the at least one first air conditioner, correcting the control information of the air conditioner based on a difference in type of the users, to obtain corrected control information; and controlling the operation of the air conditioner according to the corrected control information.

In some embodiments, the operation of determining at least one first air conditioner within a first preset distance from the air conditioner includes:

collecting an internet protocol (IP) address of the air conditioner, calculating geographical location of the air conditioner according to a longitude and a latitude of the air conditioner converted from the IP address; and determining the at least one first air conditioner within the first preset distance from the air conditioner based on the geographic location.

In some embodiments, the operation of determining at least one first air conditioner within a first preset distance from the air conditioner includes:

determining a residential area within the first preset distance from the air conditioner based on geographical location of the air conditioner; and marking an air conditioner in the residential area as the first air conditioner.

In another aspect, the present disclosure provides an electronic device. The electronic device includes: a memory, a processor and a program for controlling an air conditioner which stored in the memory and executable by the processor, the program when being executed by the processor performing operations of the method described above.

In some embodiments, the electronic device is an air conditioner.

In still another aspect, the present disclosure provides a computer-readable storage medium. The computer-readable storage medium stores a program for controlling an air conditioner when being executed by the processor performing operations of the method described above.

In accordance with the present disclosure, by finding the neighbor air conditioner of the air conditioner through the geographic location, the control information of the air conditioner can be obtained by using the current control parameter of the neighbor air conditioner. Since the environmental information such as the climate between the air conditioners relatively close to each other is similar, the requirements for these air conditioners are almost the same, and accordingly accurate control information of the air conditioner can be obtained, which is applied to accurately and reasonably control the operation of the air conditioner, thereby improving the comfort of the air conditioning.

The realizing of the aim, functional characteristics and advantages of the present disclosure are further described in detail with reference to the accompanying drawings and the embodiments.

DETAILED DESCRIPTION OF THE EMBODIMENTS

It will be appreciated that the specific embodiments described herein are merely illustrative of the present disclosure and are not intended to limit the present disclosure.

The main solution according to an embodiment of the present disclosure is: determining at least one first air conditioner within a first preset distance from the air conditioner; determining control information of the air conditioner based on current operating state of the at least one first air conditioner; and controlling operation of the air conditioner based on the control information of the air conditioner.

Because the manner relying on the historical control records is only applicable to the air conditioners that have been controlled by users. However, in case of a newly purchased air conditioner, or an air conditioner that is put into use again after being on shelf for a long time, there may be an error in controlling the air conditioner due to changes in climate or weather, thereby adversely impacting the comfort. In accordance with the present disclosure, by finding a neighbor air conditioner of the air conditioner through geographic location, the control information of the air conditioner can be obtained by using the current control parameter of the neighbor air conditioner. Since the environmental information such as the climate between air conditioners relatively close to each other is similar, the requirements for these air conditioners are almost the same, and accordingly accurate control information of the air conditioner can be obtained, which is applied to accurately and reasonably control the operation of the air conditioner, thereby improving the comfort of the air conditioning.

Figure 1:
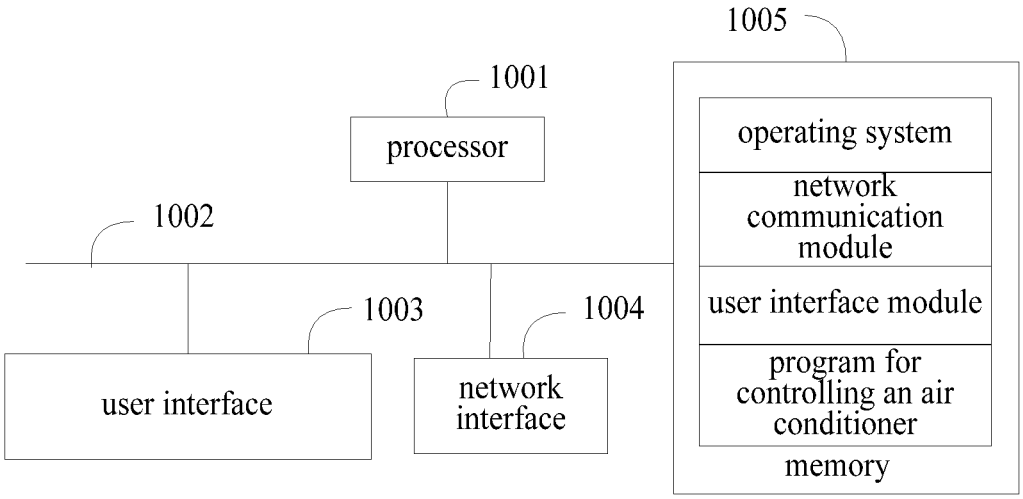
FIG. 1 is a structural diagram of a terminal to which a device belongs in a hardware operating environment according to an embodiment of this disclosure.

FIG. 1 is a structural diagram of a terminal to which a device belongs in a hardware operating environment according to an embodiment of this disclosure.

The terminal in the present disclosure may be an electronic device or a server connected to the air conditioner, or may directly be the air conditioner. The terminal finds the neighbor air conditioner of the air conditioner based on the geographic location, and then obtaining the control information of the air conditioner by using the current control parameter of the neighbor air conditioner. Since the environmental information such as the climate between the air conditioners relatively close to each other is similar, the requirements for these air conditioners are almost the same, and accordingly accurate control information of the air conditioner can be obtained, which is applied to accurately and reasonably control the operation of the air conditioner, thereby improving the comfort of the air conditioning.

As shown in FIG. 1, the terminal may include: a processor 1001, such as a CPU, a network interface 1004, a user interface 1003, a memory 1005, and a communication bus 1002. The communication bus 1002 is configured to facilitate connection and communication between these components. The user interface 1003 may include a display, an input unit such as a keyboard, and an optional user interface 1003 may also include a standard wired interface and wireless interface. The network interface 1004 may optionally include a standard wired interface, and a wireless interface (such as a WI-FI interface). The memory 1005 may be a high-speed RAM memory, or a non-volatile memory such as a disk memory. The memory 1005 optionally may also be a storage device that is separate from the processor 1001 described above.

Optionally or alternatively, the terminal may also include a WiFi module and the like. The terminal is connected to the external device through the WiFi module, so as to communicate data and transmit the control information.

Those skilled in the art can understand that the structure of the terminal shown in FIG. 1 does not constitute a limitation on the terminal. Thus, the terminal may include more or less components than those shown, or some components to be combined, or different arrangements of components.

As shown in FIG. 1, the memory 1005 as a non-transitory computer storage medium may include an operation system, a network communication module, a user interface module, and a program for controlling an air conditioner.

In the terminal shown in FIG. 1, the network interface 1004 is mainly configured to connect a background server and communicate data with the background server; the user interface 1003 is mainly configured to connect the client (user side) and communicate data with the client; and the processor 1001 may be configured to execute the program for controlling the air conditioner stored in the memory 1005 to perform the following operations:

determining at least one first air conditioner within a first preset distance from the air conditioner;

determining control information of the air conditioner based on current operating state of the at least one first air conditioner; and controlling operation of the air conditioner according to the control information of the air conditioner.

Further, the processor 1001 is configured to be able to execute the program stored in the memory 1005 to further perform the following operations:

determining a control parameter corresponding to the operating state of each of the at least one first air conditioner, after obtaining the current operating state of the at least one first air conditioner; and extracting one of all the determined control parameters with most occurrences as the control information of the air conditioner.

Further, the processor 1001 is configured to be able to execute the program stored in the memory 1005 to further perform the following operations:

determining environmental information of the air conditioner based on the current operating state of the at least one first air conditioner; and determining the control information of the air conditioner based on the environmental information of the air conditioner.

Further, the processor 1001 is configured to be able to execute the program stored in the memory 1005 to further perform the following operations:

deleting operating state satisfying a preset condition from the obtained current operating state of the at least one first air conditioner, marking the operating state after the deletion as new operating state; and determining the control information of the air conditioner based on the new operating state.

Further, the processor 1001 is configured to be able to execute the program stored in the memory 1005 to further perform the following operations:

in response to a determination that there is no first air conditioner within the first preset distance, determining a second air conditioner within a distance larger than a second preset distance; and obtaining current operating state of the second air conditioner, and determining the control information of the air conditioner, based on a difference between the first preset distance and the second preset distance, and the current operating state of the second air conditioner, where the second preset distance is larger than the first preset distance.

Further, the processor 1001 is configured to be able to execute the program stored in the memory 1005 to further perform the following operations:

determining a compensation value for the control information based on the difference between the first preset distance and the second preset distance; and correcting the control information of the air conditioner with the compensation value, and taking the corrected control information as the control information of the air conditioner.

Further, the processor 1001 is configured to be able to execute the program stored in the memory 1005 to further perform the following operations:

in response to a difference in the number of users being currently served by the air conditioner and the number of users being currently served by the at least one first air conditioner, correcting the control information of the air conditioner based on the difference in the number of users, to obtain corrected control information; and controlling the operation of the air conditioner according to the corrected control information.

Further, the processor 1001 is configured to be able to execute the program stored in the memory 1005 to further perform the following operations:

in response to a difference in the number of users being currently served by the air conditioner and the number of users being currently served by the at least one first air conditioner, correcting the control information of the air conditioner based on a difference in state of the users, to obtain corrected control information; and controlling the operation of the air conditioner according to the corrected control information.

Further, the processor 1001 is configured to be able to execute the program stored in the memory 1005 to further perform the following operations:

in response to a difference in the number of users being currently served by the air conditioner and the number of users being currently served by the at least one first air conditioner, correcting the control information of the air conditioner based on a difference in type of the users, to obtain corrected control information; and controlling the operation of the air conditioner according to the corrected control information.

Further, the processor 1001 is configured to be able to execute the program stored in the memory 1005 to further perform the following operations:

collecting an Internet Protocol (IP) address of the air conditioner, calculating geographical location of the air conditioner according to a longitude and a latitude of the air conditioner converted from the IP address; and determining the at least one first air conditioner within the first preset distance from the air conditioner based on the geographic location.

Further, the processor 1001 is configured to be able to execute the program stored in the memory 1005 to further perform the following operations:

determining a residential area within the first preset distance from the air conditioner based on geographical location of the air conditioner; and marking an air conditioner in the residential area as the first air conditioner.

Figure 2:
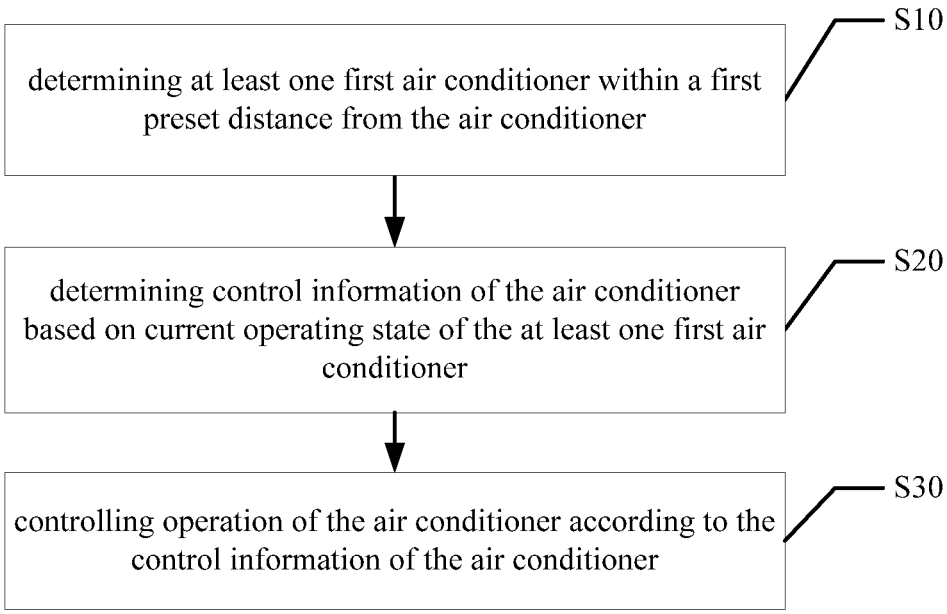
FIG. 2 is a flowchart diagram of a method for controlling an air conditioner according to an embodiment of the present disclosure.

Referring to FIG. 2, the present disclosure provides a method for controlling an air conditioner according to a first embodiment, the method including:

Step S10, determining at least one first air conditioner within a first preset distance from the air conditioner.

In this embodiment, during the process of controlling the air conditioner, the geographical location of the air conditioner is obtained. The geographical location of the air conditioner may be obtained through GPS information, or positioning information such as an IP address. In response to obtaining the geographical location of the air conditioner, at least one first air conditioner within the first preset distance from the air conditioner can be determined based on the geographical location. In addition, since each air conditioner is provided with the WiFi module for communicating with external devices (such as remote controls, mobile phones, etc.), the IP address of the WiFi access point to which the air conditioner is connected can be queried, and accordingly the geographical location of the air conditioner can be obtained through the IP address.

Figure 3:
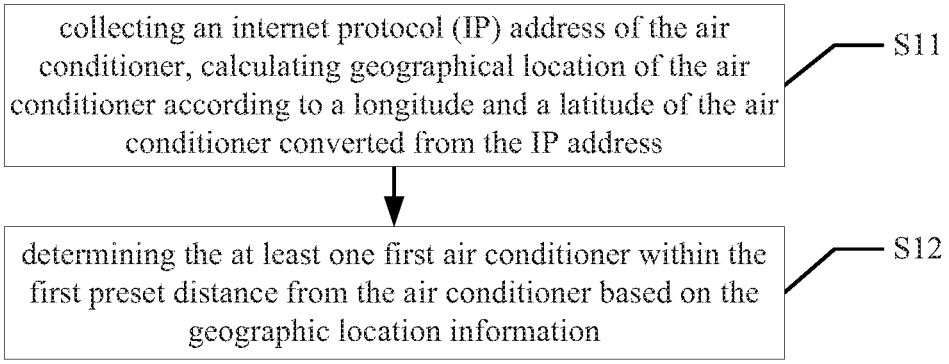
FIG. 3 is a flowchart diagram of obtaining geographic location of the air conditioner, and determining the at least one first air conditioner within the first preset distance from the air conditioner based on the geographic location according to an embodiment of the present disclosure.

In specific, referring to FIG. 3, the operation of obtaining the geographical location of the air conditioner, and determining at least one first air conditioner within the first preset distance from the air conditioner based on the geographical location include:

step S11, collecting an IP address of the air conditioner, calculating the geographical location of the air conditioner according to a longitude and a latitude of the air conditioner converted from the IP address; and step S12, determining the at least one first air conditioner within the first preset distance from the air conditioner based on the geographic location.

By converting the IP address to the longitude lng and the latitude lat, N neighbor air conditioners nearest to the air conditioner can be found based on the geographic location (the longitude and the latitude) of the air conditioner. Herein the "nearest" refers to being within the first preset distance. For example, the first preset distance is configured with 1 km or 2 km. The first preset distance may be configured according to the weather and climate conditions. In an area within the first preset distance, the weather condition is similar to each other. It will be appreciated that, in some area where there is a large change in climate, the first preset distance may be configured with different values based on different directions. For example, the first preset distance is configured with 200 meters in the direction from south to north, and configured with 1 km in the direction from east to west. The distance (Euclidean distance) between air conditioners is calculated as follows:

$$\text{distance}(i,j)=\sqrt{(\text{lng}_i-\text{lng}_j)^2+(\text{lat}_i-\text{lat}_j)^2}$$

wherein: distance (i, j) represents a distance between the air conditioner i and the air conditioner j; $\text{lat}_i$ and $\text{lng}_i$ respectively represent the latitude and the longitude of the air conditioner i.

It will be appreciated that, in some other embodiments, the geographical location of the air conditioner may be obtained in other manners, such as performing the GPS positioning.

Figure 4:
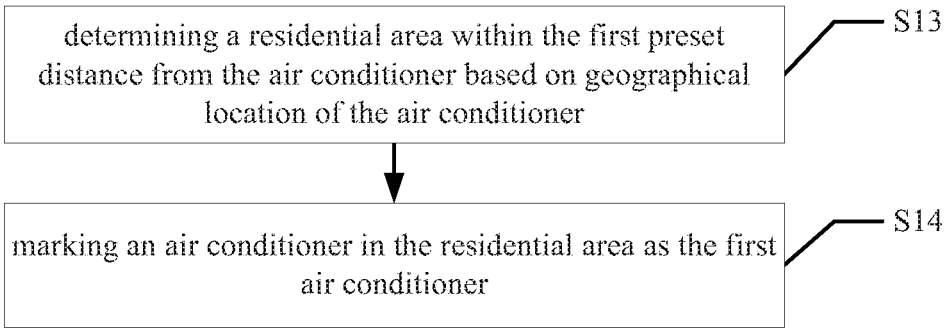
FIG. 4 is a flowchart diagram of determining a first air conditioner according to an embodiment of the present disclosure.

In an embodiment, referring to FIG. 4, the operation of determining the first air conditioner may include: step S13, determining a residential area within the first preset distance from the air conditioner based on geographical location of the air conditioner; and step S14, marking an air conditioner in the residential area as the first air conditioner.

The residential area nearest to the air conditioner is determined based on the geographic location, and then on-state air conditioners within the residential area are obtained. The obtained air conditioners are marked as the first air conditioners, namely the nearest N neighbor air conditioners. Further, if the first air conditioners are plural, according to distribution of the residential area, the air conditioners in a side near the air conditioner are to be marked as the first air conditioners.

Step S20, determining control information of the air conditioner based on current operating state of the at least one first air conditioner.

After determining the at least one first air conditioner, the current operating states of the at least one first air conditioner are obtained, and the control information of the air conditioner is determined based on the current operating states of the at least one first air conditioner. Because the determined first air conditioners and the air conditioner are neighbors, they have a similar condition in each aspect, and users may be expected for a similar control. Thus, the control information of the air conditioner may be determined based on the operating state of the at least one first air conditioner.

Figure 5:
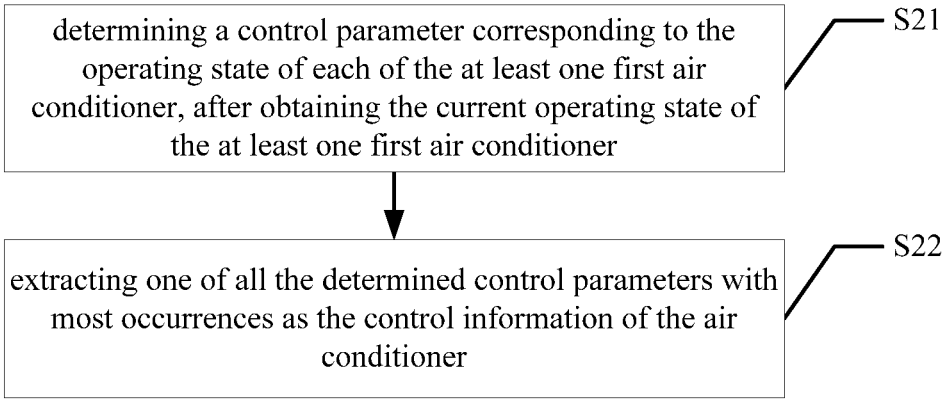
FIG. 5 is a flowchart diagram of determining control information of the air conditioner according to current operating state of a first air conditioner according to an embodiment of the present disclosure.

In specific, referring to FIG. 5, in an embodiment, the operation of determining control information of the air conditioner based on the current operating state of the at least one first air conditioner includes:

step S21, determining a control parameter corresponding to the operating state of each of the at least one first air conditioner, after obtaining the current operating states of the at least one first air conditioner; and step S22, extracting one of the determined control parameters with most occurrences as the control information of the air conditioner.

The operation of extracting one of all the determined control parameters with most occurrences may be performed as: in case of N neighbor air conditioners, the control information of the air conditioner is recommended by using a voting method. The occurrences of each mode, temperature, and wind speed are calculated as follows:

$$MC_l = \sum_{k=1}^{N} I(M_k = M^l)$$

$$TC_m = \sum_{k=1}^{N} I(T_k = T^m)$$

$$WC_n = \sum_{k=1}^{N} I(W_k = W^n)$$

wherein: $M_k$, $T_k$, and $W_k$ respectively represent the current operating mode, the current temperature, and the current wind speed of the kth neighbor; $M_l$ represents mode l, $T_m$ represents the temperature m, $W_n$ represents the wind speed n; $MC_l$ represents the occurrences of the mode l, $TC_m$ represents the occurrences of the temperature m, $WC_n$ represents the occurrences of the wind speed n. I (x=X) represents a function, if satisfying the condition (x=X), returning 1; otherwise, returning 0.

Extracting the mode, the temperature, and the wind speed with the most occurrences as the recommended configurations:

M=max($MC_l$), lε{cooling, heating, automatic};

T=max($TC_m$), mε[17, 30;];

W=max($WC_n$), nε{light wind, moderate wind, strong wind, automatic};

wherein: M, T, and W are the recommended control information including the mode, the temperature, and the wind speed.

For example, an air conditioner is randomly selected in the system, the geographical location of the selected air conditioner is: longitude 113.3, latitude 22.5; N neighbor air conditioners nearest to the air conditioner are found, suppose the found air conditioners are as follows:

longitude (113.3), latitude (22.5), setting mode (automatic), setting temperature (26 degrees), and setting wind speed (low wind);

longitude (113.3), latitude (22.6), setting mode (cooling), setting temperature (25 degrees), and setting wind speed (moderate wind);

longitude (113.4), latitude (22.5), setting mode (cooling), setting temperature (24 degrees), and setting wind speed (low wind);

longitude (113.2), latitude (22.7), setting mode (cooling), setting temperature (25 degrees), and setting wind speed (automatic).

According to the voting method, the recommended mode, temperature, and wind speed are respectively cooling, 25 degrees, and low wind. The recommended configurations are returned to the air conditioner.

Figure 6:
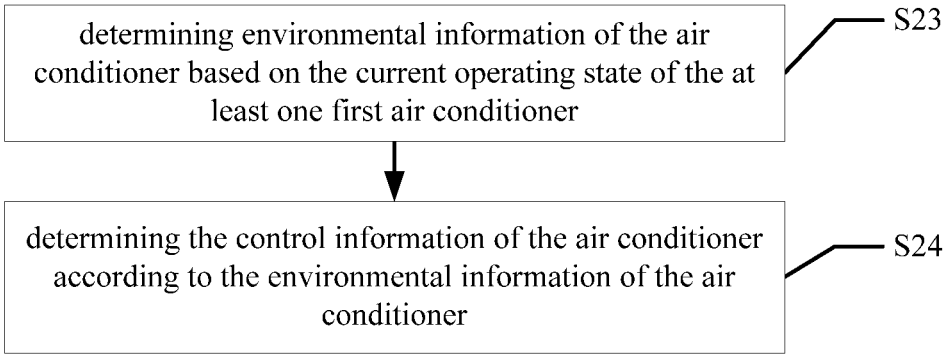
FIG. 6 is a flowchart diagram of determining control information of the air conditioner according to current operating state of a first air conditioner according to another embodiment of the present disclosure.

In specific, referring to FIG. 6, in an embodiment, the operation of determining control information of the air conditioner based on the current operating state of the at least one first air conditioner includes:

step S23, determining environmental information of the air conditioner based on the current operating state of the at least one first air conditioner; and step S24, determining the control information of the air conditioner based on the environmental information of the air conditioner.

The closer the geographical location is, the more similar the climate condition and the environmental information are, and the more similar the requirement for controlling the air conditioner is. The operating state of the air conditioner varies with the climate condition/environmental information. Therefore, the environmental information can be determined based on the operating state, and the control information of the air conditioner can then be determined based on the environmental information. A mapping relationship between the environmental information and the control information is configured in advance, and is also associated with the indoor environmental information of the air conditioner, such as the number of users and the type of the users (elderly, children, patients, etc.). By obtaining the control information based on the environmental information combined with the user information of the space where the air conditioner is operated, the air conditioner can be controlled more accurately and reasonably.

Figure 7:
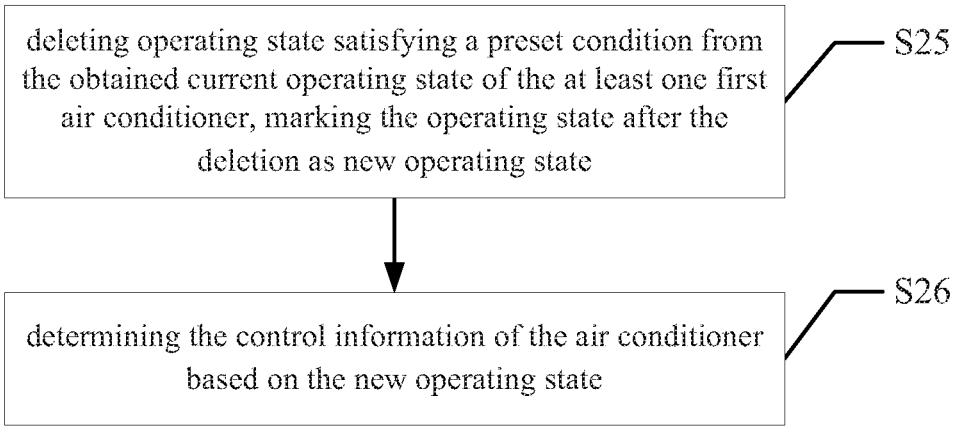
FIG. 7 is a flowchart diagram of determining control information of the air conditioner according to current operating state of a first air conditioner according to still another embodiment of the present disclosure.

In specific, referring to FIG. 7, in an embodiment, the operation of determining control information of the air conditioner based on the current operating state of the at least one first air conditioner includes:

step S25, deleting operating state satisfying a preset condition from the obtained current operating state of the at least one first air conditioner, and marking the operating state after the deletion as new operating state; and step S26, determining the control information of the air conditioner based on the new operating state.

Even if the environmental information and other external information are the same, there may exist some special situations will with respect to different homes. For example, there will be many more people in the home when having a family gathering than under normal circumstance, and the control of the air conditioner will be relatively different. For another example, the control of the air conditioner will also be different for a user who has just finished exercising. The operating state satisfying the preset condition is deleted from the obtained operating states of the first air conditioners, the operating states after the deletion are marked as the new operating states, and the control information of the air conditioner is determined based on the new operating states. The operating state satisfying the preset condition is that corresponding to some special situation, not corresponding to conventional or common situation. For example, in case where the user turns on the air conditioner just after exercising, the frequency and the wind speed at this time are very high and abnormal, accordingly this operating state is in no use, and needs to be deleted. For another example, in case where the user is sick and sensitive to the cooling of the air conditioner, the frequency and the wind speed at this time are very low, accordingly this operating state is in no use, and needs to be deleted. By this, the control information of the air conditioner is ensured to be more accurate and reasonable.

Step S30, controlling operation of the air conditioner based on the control information of the air conditioner.

After determining the control information of the air conditioner, the operation of the air conditioner can be controlled based on the determined control information of the air conditioner, such as to adjust the setting temperature, the wind direction, and/or the wind speed.

Figure 8:
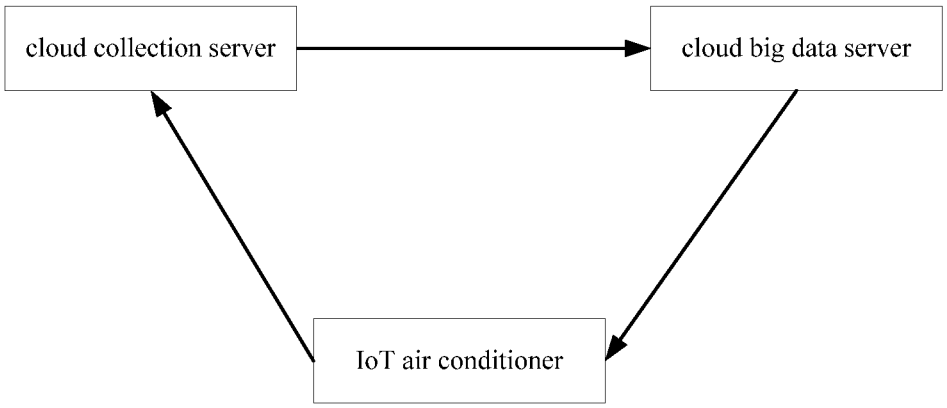
FIG. 8 is a architecture diagram of a system for controlling an air conditioner.

In order to better describe this embodiment, referring to FIG. 8, the system architecture includes a cloud collection server, a cloud big data server, and an internet of thins (IoT) air conditioner. The IoT air conditioner and the cloud collection server are both connected to the cloud big data server, and the IoT air conditioner is connected to the cloud collection server. The control in an application scenario includes:

operating state data collection: the IoT air conditioners regularly reports operating state data to the cloud collection server; the operating state data includes mode configuration, temperature configuration, and wind speed configuration;

geographic location data collection: the IoT air conditioner reports data, and at the same time reports the IP address of the air conditioner;

neighbors searching: the N neighbors nearest to the air conditioner are searched based on the geographic location (longitude lng, latitude lat) of the air conditioner;

air conditioner control parameter obtaining: the cloud big data server calculates the recommended air conditioner control parameters by the voting method according to the current operating states of the N neighbors, and returns the recommended air conditioner control parameters to the air conditioner; and air conditioner controlling: the air conditioner operates according to the air conditioner control parameters returned by the cloud big data server, the control parameters including mode, temperature, wind speed, etc.

In this embodiment, by finding the neighbor air conditioner of the air conditioner through the geographic location, the control information of the air conditioner can be obtained by using the current control parameter of the neighbor air conditioner. Since the environmental information such as the climate between the air conditioners relatively close to each other is similar, the requirements for these air conditioners are almost the same, and accordingly accurate control information of the air conditioner can be obtained, which is applied to accurately and reasonably control the operation of the air conditioner, thereby improving the comfort of the air conditioning.

Figure 9:
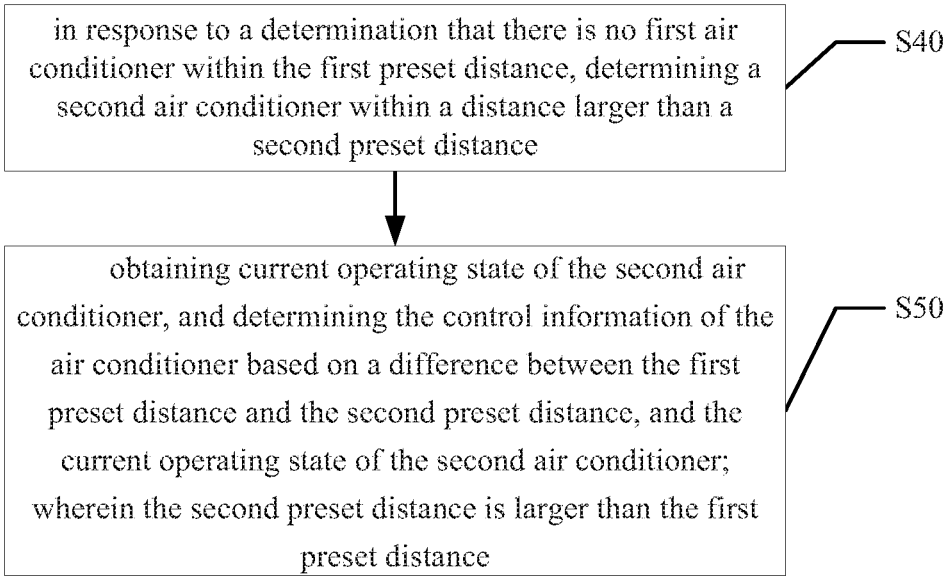
FIG. 9 is a flowchart diagram of a method for controlling an air conditioner according to another embodiment of the present disclosure.

Referring to FIG. 9, in some embodiments, the method further includes:

step S40, in response to a determination that there is no first air conditioner within the first preset distance, determining a second air conditioner within a distance larger than a second preset distance; and step S50, obtaining current operating state of the second air conditioner, and determining the control information of the air conditioner based on a difference between the first preset distance and the second preset distance, and the current operating state of the second air conditioner, where the second preset distance is larger than the first preset distance.

The compensation value for the control information of the air conditioner within the distance larger than the first distance is set in advance. The compensation value varies with the difference in distance. If response to no presence of the first air conditioner within the first preset distance, it is to determine the air conditioners within the distance larger than the second distance. The second preset distance is larger than the first preset distance. Generally, when the distance is larger than the second preset distance, there may exist a large difference in the environmental information of the air conditioners, which may result in a difference in the control accuracy of the air conditioner. In this embodiment, this difference is made up with the compensation value. The compensation value is set according to the parameters such as weather, distance, and the difference in user group, and the corresponding relationship is set in advance, thereby improving the control accuracy of the air conditioner. The compensation value is selected according to the environmental information such as the climate, and configured with different values in different directions.

Figure 10:
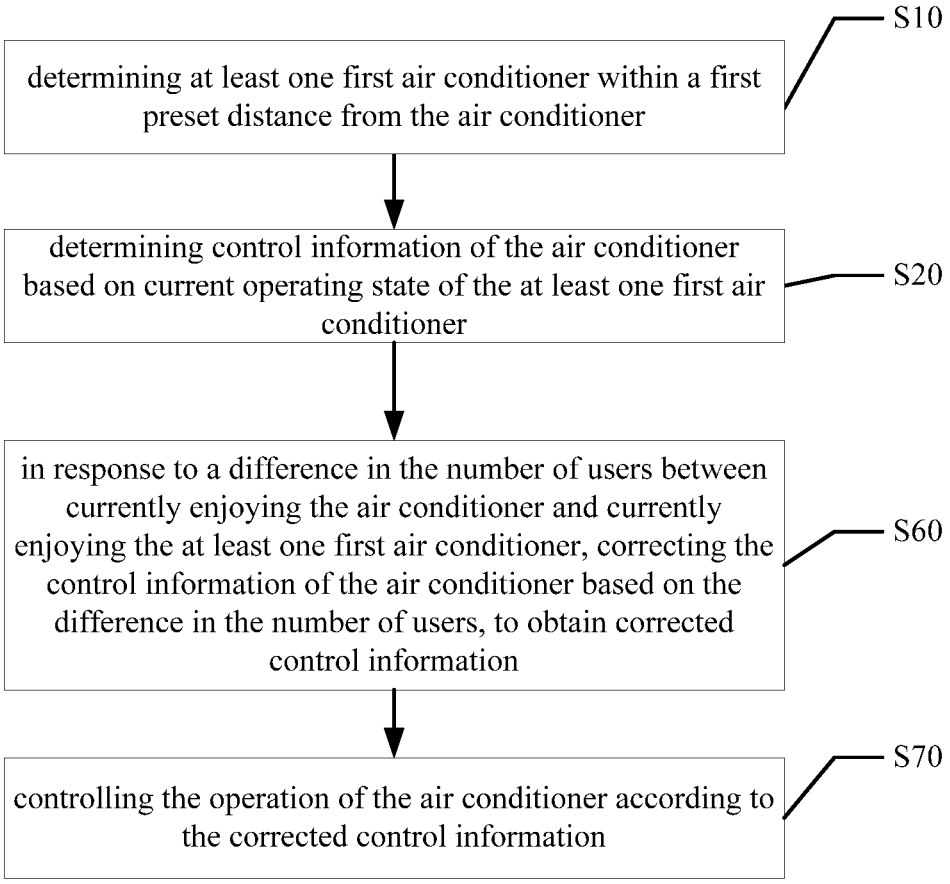
FIG. 10 is a flowchart diagram of a method for controlling an air conditioner according to still another embodiment of the present disclosure.

Referring to FIG. 10, in some embodiments, after the operation of determining control information of the air conditioner based on the current operating state of the at least one first air conditioner, the method further includes:

Step S60, in response to a difference in the number of users between currently enjoying the air conditioner and currently enjoying the at least one first air conditioner, correcting the control information of the air conditioner based on the difference in the number of users, to obtain corrected control information; and Step S70, controlling the operation of the air conditioner according to the corrected control information.

If the number of users are different in the space where the air conditioner is operated, the control for the air conditioner is different, and the control information can be corrected according to the difference in the number of users. For example, when the air conditioner is cooling, the setting temperature in case of more users is lower than the setting temperature in case of fewer users. For a more specific example, the setting temperature is 24 degrees in case of 5 users, while the setting temperature is 26 degrees in case of 2 users. By correcting the control information according to the number of users, the air conditioner is subjected to a more accurate control. In addition, the compensation may be performed based on the difference in state or type of the users. For example, in case where the air conditioner is cooling for a user after exercising, the setting temperature will be lower, and the wind speed will be larger. For another example, the setting temperature in case of an elderly person is lower than the setting temperature in case of a young person. By eliminating the difference between the air conditioner and the neighbor air conditioner through the compensation, the air conditioner can be controlled more accurately.

In addition, the present disclosure provides an electronic device including a memory, a processor, and a program for controlling an air conditioner stored in the memory and executable by the processor. The program when being executed by the processor performs the operations of the above methods according to FIGS. 2 to 5, which is not detailed herein. Optionally, the electronic device is an air conditioner.

In addition, the present disclosure provides a non-transitory computer-readable storage medium storing a program for controlling an air conditioner. The program when being executed by the processor performs the following operations:

determining at least one first air conditioner within a first preset distance from the air conditioner;

determining control information of the air conditioner based on current operating state of the at least one first air conditioner; and controlling operation of the air conditioner according to the control information of the air conditioner.

Further, the program when being executed by the processor performs the following operations:

determining a control parameter corresponding to the operating state of each of the at least one first air conditioner, after obtaining the current operating state of the at least one first air conditioner; and extracting one of all the determined control parameters with most occurrences as the control information of the air conditioner.

Further, the program when being executed by the processor performs the following operations:

determining environmental information of the air conditioner based on the current operating state of the at least one first air conditioner; and determining the control information of the air conditioner based on the environmental information of the air conditioner.

Further, the program when being executed by the processor performs the following operations:

deleting operating state satisfying a preset condition from the obtained current operating state of the at least one first air conditioner, marking the operating state after the deletion as new operating state; and determining the control information of the air conditioner based on the new operating state.

Further, the program when being executed by the processor performs the following operations:

in response to a determination that there is no first air conditioner within the first preset distance, determining a second air conditioner within a distance larger than a second preset distance; and obtaining current operating state of the second air conditioner, and determining the control information of the air conditioner, based on a difference between the first preset distance and the second preset distance, and the current operating state of the second air conditioner, where the second preset distance is larger than the first preset distance.

Further, the program when being executed by the processor performs the following operations:

determining a compensation value for the control information based on the difference between the first preset distance and the second preset distance; and correcting the control information of the air conditioner with the compensation value, and taking the corrected control information as the control information of the air conditioner.

Further, the program when being executed by the processor performs the following operations:

in response to a difference in the number of users between currently enjoying the air conditioner and currently enjoying the at least one first air conditioner, correcting the control information of the air conditioner based on the difference in the number of users, to obtain corrected control information; and controlling the operation of the air conditioner according to the corrected control information.

Further, the program when being executed by the processor performs the following operations:

in response to a difference in the number of users between currently enjoying the air conditioner and currently enjoying the at least one first air conditioner, correcting the control information of the air conditioner based on a difference in state of the users, to obtain corrected control information; and controlling the operation of the air conditioner according to the corrected control information.

Further, the program when being executed by the processor performs the following operations:

in response to a difference in the number of users between currently enjoying the air conditioner and currently enjoying the at least one first air conditioner, correcting the control information of the air conditioner based on a difference in type of the users, to obtain corrected control information; and controlling the operation of the air conditioner according to the corrected control information.

Further, the program when being executed by the processor performs the following operations:

collecting an IP address of the air conditioner, calculating geographical location of the air conditioner according to a longitude and a latitude of the air conditioner converted from the IP address; and determining the at least one first air conditioner within the first preset distance from the air conditioner based on the geographic location.

Further, the program when being executed by the processor performs the following operations:

determining a residential area within the first preset distance from the air conditioner based on geographical location of the air conditioner; and marking an air conditioner in the residential area as the first air conditioner.

The foregoing description merely portrays some illustrative embodiments in accordance with the disclosure and therefore is not intended to limit the patentable scope of the disclosure. Any equivalent structure or flow transformations that are made taking advantage of the specification and accompanying drawings of the disclosure and any direct or indirect applications thereof in other related technical fields shall all fall in the scope of protection of the disclosure.

What is claimed is:

1. A method for controlling an air conditioner, the method comprising:

determining existence of at least one first air conditioner within a first range of said air conditioner, wherein the first range is determined based on a first preset distance from said air conditioner;

in response to a determination of the existence of the at least one first air conditioner, obtaining control information of said air conditioner, comprising:

obtaining a current operating state of the at least one first air conditioner, determining a control parameter corresponding to the current operating state of the at least one first air conditioner, and designating the control parameter as the control information of said air conditioner; and controlling operation of said air conditioner according to the control information of said air conditioner, wherein the determining the existence of the at least one first air conditioner within the first range of said air conditioner comprises:

collecting an Internet Protocol (IP) address of said air conditioner;

calculating geographical location of said air conditioner according to a longitude and a latitude of said air conditioner converted from the IP address; and determining the existence of the at least one first air conditioner within the first range based on the geographic location.

2. The method according to claim 1, wherein the at least one first air conditioner comprises a plurality of first air conditioners; and wherein the obtaining the control information of said air conditioner comprises:

obtaining a current operating state of each of the plurality of first air conditioners;

determining control parameters corresponding to the current operating states of the plurality of first air conditioners; and extracting one of the control parameters with most occurrences and designating the extracted control parameter as the control information of said air conditioner.

3. The method according to claim 1, wherein in an area where a difference between climate in a first direction and climate in a second direction exceeds a predetermined amount, the first preset distance is configured with different values according to whether the first preset distance is in the first direction or whether the first preset distance is in the second direction.

4. The method according to claim 1, wherein the obtaining the control information of said air conditioner comprises:

determining environmental information of said air conditioner based on the current operating state of the at least one first air conditioner; and determining the control information of said air conditioner based on the environmental information of said air conditioner.

5. The method according to claim 1, wherein the obtaining the control information of said air conditioner comprises:

deleting an operating state satisfying a preset condition from the current operating state of the at least one first air conditioner;

marking an operating state of the at least one first air condition after the deletion as a new operating state; and determining the control information of said air conditioner based on the new operating state.

6. The method according to claim 1, further comprising:

in response to a determination of non-existence of the at least one first air conditioner within the first range of said air conditioner, determining existence of a second air conditioner within a second range of said air conditioner, wherein the second range is determined based on a second preset distance from said air conditioner, wherein the second present distance is larger than the first preset distance;

obtaining a current operating state of the second air conditioner; and determining the control information of said air conditioner, based on the current operating state of the second air conditioner and the difference between the first preset distance and the second preset distance.

7. The method according to claim 6, wherein the determining the control information of said air conditioner, based on the current operating state of the second air conditioner and the difference between the first preset distance and the second preset distance comprises:

determining a compensation value for the control information based on the difference between the first preset distance and the second preset distance; and correcting the control information of said air conditioner with the compensation value, and taking the corrected control information as the control information of said air conditioner.

8. The method according to claim 1, further comprising:

after the obtaining the control information of said air conditioner:

in response to a difference in the number of users currently served by said air conditioner and the number of users currently served by the at least one first air conditioner, correcting the control information of said air conditioner based on the difference, to obtain corrected control information; and controlling the operation of said air conditioner according to the corrected control information.

9. The method according to claim 1, further comprising:

after the obtaining the control information of said air conditioner:

in response to a difference in a state of the user currently served by said air conditioner and a state of the user currently served by the at least one first air conditioner, correcting the control information of said air conditioner based on the difference, to obtain corrected control information; and controlling the operation of said air conditioner according to the corrected control information.

10. The method according to claim 1, further comprising:

after the obtaining the control information of said air conditioner:

in response to a difference in a type of the user currently served by said air conditioner and a type of the user currently served by the at least one first air conditioner, correcting the control information of said air conditioner based on the difference, to obtain corrected control information; and controlling the operation of said air conditioner according to the corrected control information.

11. The method according to claim 1, wherein the determining the existence of the at least one first air conditioner within the first range of said air conditioner comprises:

determining a residential area within the first range of said air conditioner based on the geographical location of said air conditioner; and marking an air conditioner in the residential area as the at least one first air conditioner.

12. An electronic device comprising:

a processor; and a memory storing a program for controlling an air conditioner, wherein the program causes the processor to at least perform:

determining existence of at least one first air conditioner within a first range of said air conditioner, wherein the first range is determined based on a first preset distance from said air conditioner;

in response to a determination of the existence of the at least one first air conditioner, obtaining control information of said air conditioner, comprising:

obtaining a current operating state of the at least one first air conditioner, determining a control parameter corresponding to the current operating state of the at least one first air conditioner, and designating the control parameter as the control information of said air conditioner; and controlling operation of said air conditioner according to the control information of said air conditioner, wherein the determining the existence of the at least one first air conditioner within the first range of said air conditioner comprises:

collecting an Internet Protocol (IP) address of said air conditioner;

calculating geographical location of said air conditioner according to a longitude and a latitude of said air conditioner converted from the IP address; and determining the existence of the at least one first air conditioner within the first range based on the geographic location.

13. The electronic device according to claim 12, wherein the processor is arranged in said air conditioner.

14. A non-transitory computer-readable storage medium storing a program for controlling an air conditioner, the program causing a processor to at least perform:

determining existence of at least one first air conditioner within a first range of said air conditioner, wherein the first range is determined based on a first preset distance from said air conditioner;

in response to a determination of the existence of the at least one first air conditioner, obtaining control information of said air conditioner, comprising:

obtaining a current operating state of the at least one first air conditioner, determining a control parameter corresponding to the current operating state of the at least one first air conditioner, and designating the control parameter as the control information of said air conditioner; and controlling operation of said air conditioner according to the control information of said air conditioner, wherein the determining the existence of the at least one first air conditioner within the first range of said air conditioner comprises:

collecting an Internet Protocol (IP) address of said air conditioner;

calculating geographical location of said air conditioner according to a longitude and a latitude of said air conditioner converted from the IP address; and determining the existence of the at least one first air conditioner within the first range based on the geographic location.

* * * * *